United States Patent [19]

Bollinger

[11] Patent Number: 4,615,185

[45] Date of Patent: Oct. 7, 1986

[54] TIMEPIECE BRACELET

[75] Inventor: Hans Bollinger, Mörigen, Switzerland

[73] Assignee: Eta Sa Fabriques d'Ebauches, Granges, Switzerland

[21] Appl. No.: 692,253

[22] Filed: Jan. 17, 1985

[30] Foreign Application Priority Data

Jan. 20, 1984 [CH] Switzerland ..... 265/84

[51] Int. Cl.[4] ..... A44C 5/00

[52] U.S. Cl. ..... 63/5 R; 63/3; 24/16 PB; 24/17 A; 24/30.5 P; 224/164; 40/21 C; D11/87

[58] Field of Search ..... 24/16 R, 16 PB, 17 A, 24/17 AP, 30.5 P; 224/164, 175, 176, 179, 267; 63/3, 5 R; 40/21 C, 304; D11/87; D3/43

[56] References Cited

U.S. PATENT DOCUMENTS 2,979,794 4/1961 Bartolo ..... 24/16 PB
3,886,630 6/1975 Emery ..... 24/16 PB
4,178,751 12/1979 Liautaud ..... 224/175 X
4,499,680 2/1985 Coburn .

FOREIGN PATENT DOCUMENTS 2228243 1/1973 Fed. Rep. of Germany ... 24/16 PB
327839 3/1958 Switzerland ..... 63/5 R

*Primary Examiner*—F. Barry Shay
*Attorney, Agent, or Firm*—Sughrue, Mion, Zinn, Macpeak and Seas

[57] ABSTRACT

The bracelet clasp comprises a sleeve attached to one of the bracelet tongues. The sleeve includes transversal teeth on a part of the sleeve wall contiguous to the wrist. Such teeth cooperate with complementary teeth arranged on the other tongue of the bracelet. The sleeve is elastically deformable in the transversal sense in order to allow disengagement of the meshing teeth and thereby opening of the bracelet.

Such a bracelet may be formed as a single piece from a plastic material such as polyurethane.

7 Claims, 6 Drawing Figures

15
8
13
6
7
5
14

15
8
13
7
18
16
5
3
F1
F1
17
19
2
6
14

TIMEPIECE BRACELET

BACKGROUND OF THE INVENTION

This invention is concerned with a timepiece bracelet.

According to U.S. Pat. No. 2,979,794 it is already known to provide a securing collar for a bundle of cables which includes a clasp comprising a sleeve defining a passage which extends longitudinally relative to the tongue of the collar to which it is attached and in which there may be inserted the other tongue of the collar, one of the surfaces of this other tongue being provided with teeth extending transversally and cooperating with the teeth of a complementary set provided in the sleeve in a manner to be retained by a ratchet effect on the teeth of the sleeve, this latter being transversally deformable in order to enable release of the ratchet when the collar is opened.

The arrangement of this collar or more precisely, of its clasp, renders it particularly apt to fulfil the purpose for which it was intended, i.e. to hold the cables of a bundle together and to permit moreover release of the collar in the event that the bundle must be changed for one or another reason. It is thus because the collar exhibits relatively small width in a manner such that when the sleeve is laterally deformed to effect opening of the collar, it assumes a form of circular section which enables the disengagement without difficulty of the meshing teeth from one another.

If one attempts to apply the construction principle of this collar to the manufacture of a timepiece bracelet, initially there will appear the tendency to increase the width of the tongues in order to give them the usual dimensions applicable in horology. However, in so doing, one runs up against problems when the bracelet is to be opened (everything else being equal) for when the lateral deformation of the sleeve, which has then a cross-section of width clearly greater than its height, takes place, the sleeve takes on an oval form in locally deforming the edges of the tongue which is introduced therein. Under such conditions the teeth may not be disengaged from one another since the ridges of the teeth are maintained in contact above all at their two ends, i.e. next to the lateral edges of the sleeve. This default is moreover more pronounced to the extent that the bracelet is more tightly secured about the wrist of the user.

Another factor which aggravates further this phenomenon arises from the tendency of the tongues of the bracelet from their own elasticity to spread apart from one another when they are not attached by the clasp. Thereby the teeth are urged to inter-penetrate one another which is favourable for avoiding an undesired opening of the collar but on the other hand does not facilitate this operation when one purposely attempts to effect it. Thus, when the sleeve is laterally deformed for the opening of the bracelet, the teeth continue to be urged in the same sense, i.e. to be hooked into one another.

It will be evident that these defaults of the previously known technique which become manifest when one wishes to apply it to a timepiece bracelet, do not motivate the specialist to employ it for this particular purpose.

The invention however consists precisely in the idea of creating a bracelet for a timepiece, the basic conception thereof being drawn from this previously known technique, which is adapted in a special manner to enable it to be used for this purpose.

SUMMARY OF THE INVENTION

The invention thus has as object a timepiece bracelet including a clasp which comprises sleeve means defining a passage extending longitudinally relative to the bracelet tongue with which said sleeve is associated and in which the other tongue of the bracelet may be inserted, one of the surfaces of said other tongue being provided with transversally extending teeth arranged and adapted to mesh with complementary teeth provided within said sleeve means whereby said other tongue is retained by a ratchet effect with the teeth within said sleeve meams, said sleeve means being transversally deformable to enable release of the ratchet when the bracelet is opened and wherein the teeth within said sleeve means are arranged on that portion of the wall thereof which is contiguous to the wrist of the wearer when the bracelet is in place, the teeth of said other tongue being situated on the surface thereof facing the wrist.

There results from these characteristics that the opening of the bracelet is always effected without difficulty since when the sleeve is laterally deformed the elasticity of the tongue which is inserted has a tendency to separate the teeth from one another even in the case when the width of the bracelet is relatively important.

The bracelet according to the invention provides the advantage of being adaptable to manufacture practically in a single piece by injection moulding and thus necessitates very few assembly operations. Moreover, it presents an agreeable visual aspect.

DESCRIPTION OF THE PREFERRED EMBODIMENT

Figure 1:
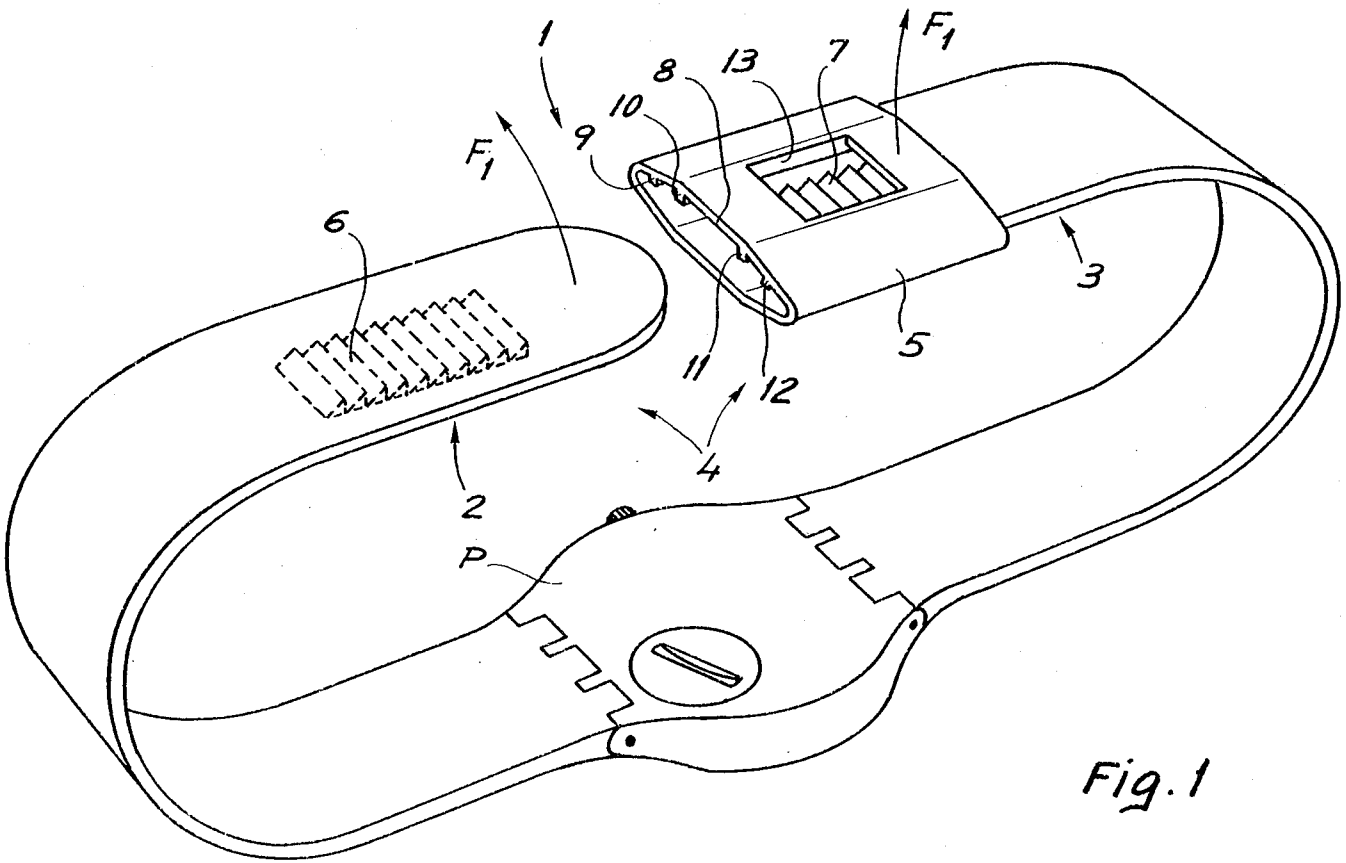
FIG. 1 is a perspective view of the bracelet according to the invention.

FIG. 1 is a perspective view of a bracelet 1 in conformity with the invention attached to a timepiece P. It comprises tongues 2 and 3 of which the free ends remote from the timepiece P form a clasp 4. The tongue 3 comprises at its free end a sleeve 5 which defines a passage extending longitudinally relative to the length of the bracelet. The mid zones of the extremities of tongues 2 and 3 are respectively provided with ratchet teeth 6 and 7. The portion 8 of sleeve 5 of tongue 3 opposite to the ratchet teeth 7 provides longitudinal ribs 9, 10, 11 and 12 which extend towards the interior opposite the ratchet teeth 7, these ribs being intended to facilitate buiding of the other tongue 2 in the sleeve 5. In the upper portion 8 opposite the ratchet teeth 7 of sleeve 5 there is provided a rectangular opening 13 of which the area corresponds to the surface of the ratchet teeth 7. This opening 13 is intended to permit attaching the ratchet teeth 7 when the manufacture of the bracelet is underway.

Figure 2:
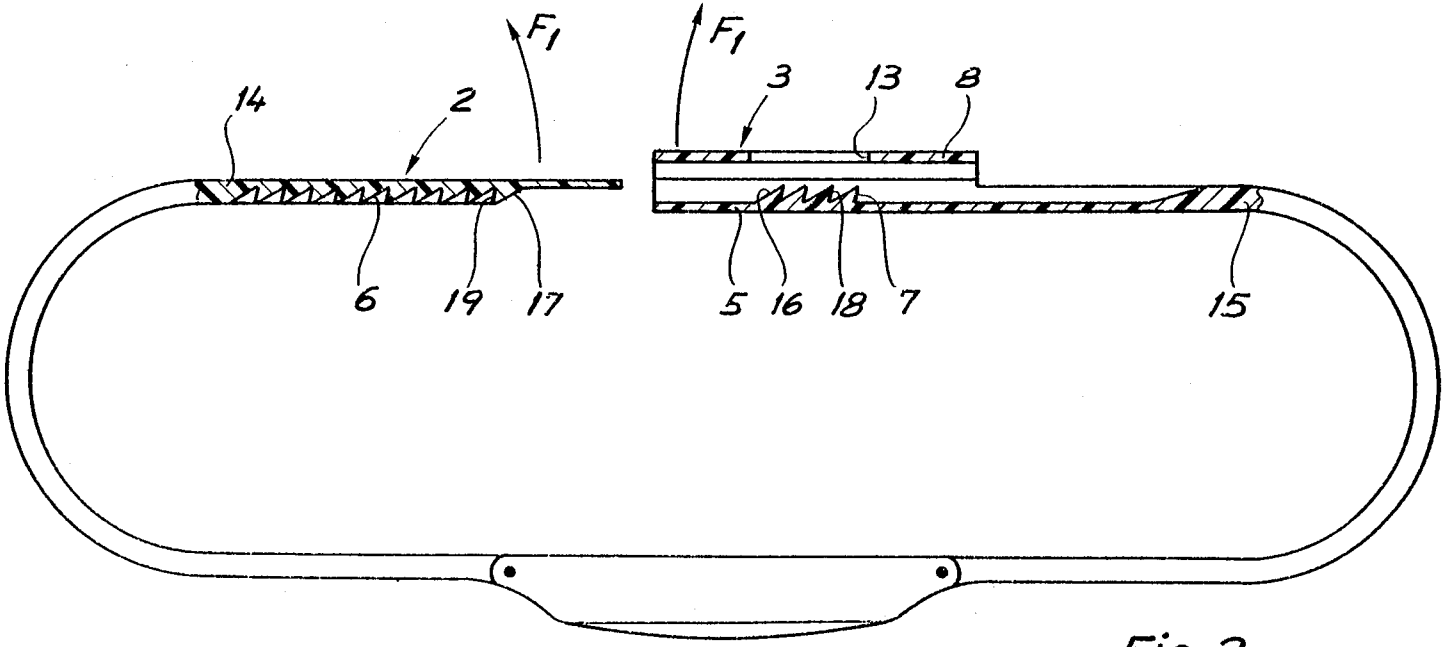
FIG. 2 is a longitudinal section of the clasp in the open position.

On FIG. 2, there is shown a longitudinal sectional view of the clasp 4. It will be seen that sleeve 5 projects from the general plane of the tongue 3 from the exterior side, i.e. remote from the wrist of the user when the bracelet is in place. It will be likewise clearly seen that the teeth 7 are located on the portion of the wall of the sleeve 5 which is contiguous to the wrist as are moreover the teeth 6 which are arranged on the other tongue 2.

Instead of forming an integral portion of the bracelet and in accordance with a variant thereof, tongues 2 and 3 may likewise be realized as separate fitted parts, i.e. mounted as in the case of numerous known clasps. However, it is advantageous that the elongations in the form of bands 14 and 15 of the clasp be formed directly to the desired length in order to obtain the bracelet. It is visible from FIG. 2 that the forward profiles 16 and 17 as well as the rear profiles 18 and 19 of the ratchet teeth 6 and 7 take a form such that they are inclined with respect to the planes parallel to elongations 14 and 15 in band form. In other words, these profiles make angles with these planes differing from 90°. This saw tooth realization of teeth 6 and 7 presents the advantage that tongue 2 may very readily be inserted into sleeve 5 while to the contrary, the withdrawal, i.e. an undesired opening of the clasp, is not possible.

Figure 3:
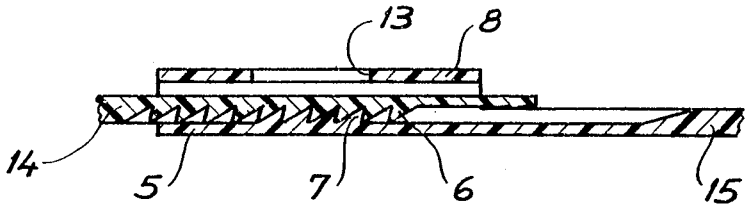
FIG. 3 is a longitudinal section of the clasp in closed position.

On FIG. 3, there is represented a longitudinal section of the clasp in its closed configuration.

Figure 4:
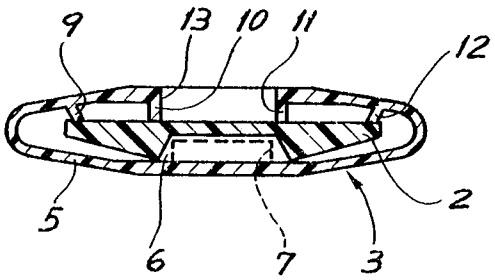

FIG. 4 shows a transversal section of the clasp in closed configuration.

Figure 5:
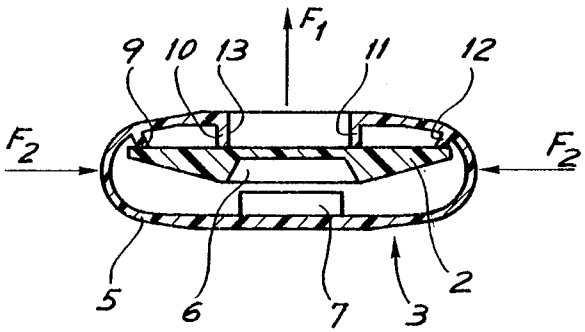
FIGS. 4 & 5 show transversal sections of the clasp respectively in a closed position and just before its opening.

On FIG. 5, there has likewise been shown a transversal section of clasp 4. By exerting pressure, for example with the index finger and the thumb in the sense of arrows $F_2$ on sleeve 5, the ratchet teeth 7 are disengaged from teeth 6 of tongue 2 by reason of the elastic deformation property of sleeve 5.

Tongues 2 and 3 having an inherent tendency to separate from one another in a manner to assume an almost flat form, i.e. to urge constantly their free ends in the sense of arrows $F_1$ on FIGS. 1, 2 and 5, it is evident that teeth 6 and 7 in turn are likewise urged in a disengaging direction when by means of lateral pressure in the sense of arrows $F_2$ (FIG. 5), the sleeve 5 is deformed. One may then readily withdraw tongue 2 from sleeve 5 without in any manner being hindered in this movement by the teeth. It is noted that the teeth do not extend beyond the longitudinal mid portion of the tongue 2, respectively sleeve 5, so that even at the lateral extremities of their edges the teeth may not hook into one another. It is well understood that following withdrawal of tongue 2, sleeve 5 will reassume its initial form to be ready to again receive tongue 2.

Figure 6:
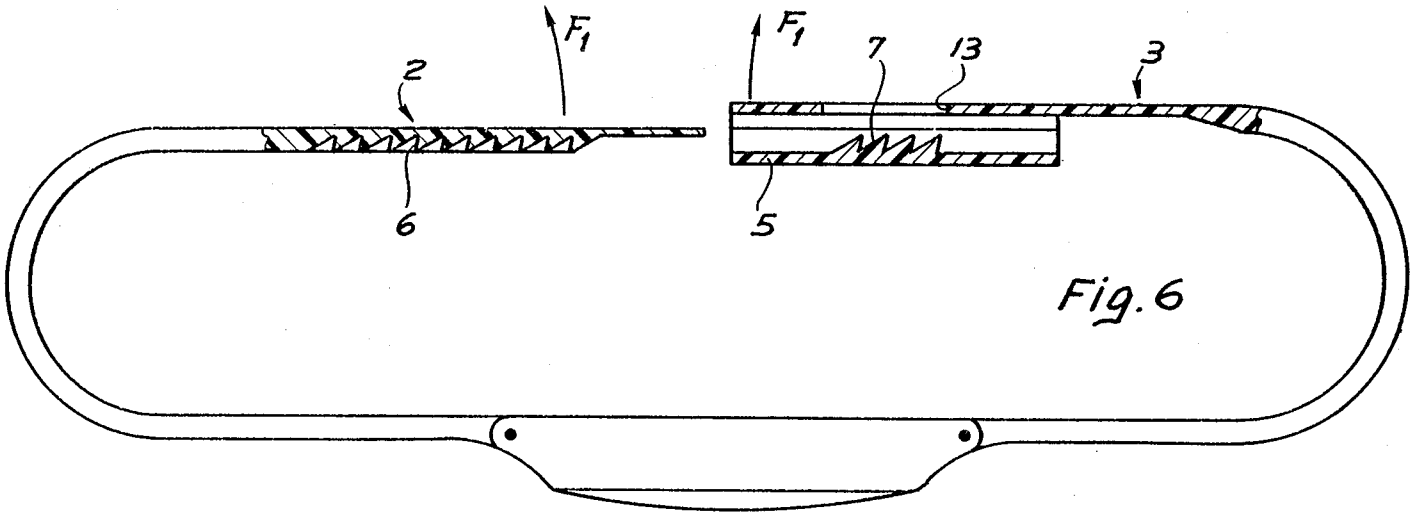
FIG. 6 is a longitudinal section of a second mode of realization.

In the form shown in FIG. 6, sleeve 5 is provided on the side proximate the wrist rather than being situated on the exterior. At the same time, it will be noted that the position of the teeth remains identical in a manner such that the same advantageous properties are likewise present in this variant. Such, moreover, has the advantage of maintaining tongue 2 in the interior of the loop formed by the bracelet, i.e. between tongue 3 and the wrist, this rendering superfluous the usual sliding loop normally provided to retain this tongue.

Another considerable advantage of the clasp which has just been described consists in that it may be almost continuously regulated, i.e. by steps corresponding to the distance between two ratchet teeth which may be approximately 2 mm. This regulation may be effected for example by introducing a fingernail between two teeth and thereafter sliding the tongue 2 in sleeve 5. The clasp may be realized in two portions while the known clasps having ratchet teeth require at least six parts. Moreover, the manufacture may be obtained in a single injection operation using an appropriate thermo-plastic material such as polyurethane.

Finally, it will be noted that in order to open clasp 4 it is necessary to apply force in the sense of arrows $F_2$ on both sides of sleeve 5 (FIG. 5), otherwise the teeth may not be disengaged. It is thus impossible that the bracelet open by one-sided impact against the clasp.

What I claim is:

1. A timepiece bracelet including two tongues with means thereon for clasping said bracelet comprising sleeve means defining a passage extending longitudinally relative to the bracelet tongue with which said sleeve is associated and in which the other tongue of the bracelet may be inserted, one of the surfaces of said other tongue being provided with transversally extending teeth arranged and adapted to mesh with complementary teeth provided within said sleeve means whereby said other tongue is retained by a ratchet effect of the teeth thereon with the teeth within said sleeve means, said sleeve means being transversally deformable by manual pressure whereby to increase the dimension of the sleeve means passage radially of the bracelet sufficiently to enable release of the teeth from each other when the bracelet is opened and wherein the teeth within said sleeve means are arranged on that portion of the wall thereof which is contiguous to the wrist of the wearer when the bracelet is in place, the teeth of said other tongue being situated on the surface thereof facing the wrist.

2. A timepiece bracelet as set forth in claim 1 wherein the teeth respectively provided on said other tongue and within said sleeve means are arranged on the longitudinal mid-portions thereof.

3. A timepiece bracelet as set forth in claim 1 wherein longitudinal reinforcing ribs are provided on the portion of the wall of the sleeve means opposite to that on which the teeth are arranged.

4. A timepiece bracelet as set forth in claim 1 wherein the respective profiles of the teeth provided on said other tongue and within said sleeve form angles differing from 90° with planes parallel to the tongues.

5. A timepiece bracelet as set forth in claim 1 wherein said sleeve is placed on the side of the tongue proximate the wrist of the user.

6. A timepiece bracelet as set forth in claim 1 wherein said sleeve is placed on the side of the tongue remote from the wrist of the user.

7. A timepiece bracelet including a pair of tongues with means thereon for clasping said bracelet comprising sleeve means defining a passage extending longitudinally relative to the bracelet tongue with which said sleeve is associated and in which the other tongue of the bracelet may be inserted, one of the surfaces of said other tongue being provided with transversally extending teeth arranged and adapted to mesh with complementary teeth provided within said sleeve means whereby said other tongue is retained by a ratchet effect of the teeth thereon with the teeth within said sleeve means, said sleeve means being transversally deformable by manual pressure whereby to increase the dimension of the sleeve means passage radially of the bracelet sufficiently to enable release of the teeth from each other when the bracelet is opened and wherein the teeth within said sleeve means are arranged on that portion of the wall thereof which is contiguous to the wrist of the wearer when the bracelet is in place, the teeth of said other tongue being situated on the surface thereof facing the wrist, said sleeve being placed on the side of the tongue proximate the wrist of the user, and the wall of said sleeve opposite the teeth of said sleeve having an opening in front of said teeth.

* * * * *